US006021882A

United States Patent [19]

Juds et al.

[11] Patent Number: 6,021,882

[45] Date of Patent: Feb. 8, 2000

[54] TOKEN HAVING PREDETERMINED OPTICAL CHARACTERISTICS AND A TOKEN VALIDATION DEVICE THEREFOR

[75] Inventors: Scott Juds, Everett; Dave Dauterman, Bothell, both of Wash.

[73] Assignee: IDX, Inc., El Dorado, Ark.

[21] Appl. No.: 09/041,297

[22] Filed: Mar. 12, 1998

[51] Int. Cl.[7] ..... G07F 7/00; G05G 1/00; G09F 3/02

[52] U.S. Cl. ..... 194/212; 194/214; 40/27.5

[58] Field of Search ..... 194/212, 213, 194/214; 40/27.5

[56] References Cited

U.S. PATENT DOCUMENTS

| | | | |
|---|---|---|---|
| D. 81,175 | 5/1930 | Boylan | 194/214 |
| 1,455,289 | 5/1923 | Heene | 40/27.5 |
| 2,983,354 | 5/1961 | Ember et al. | 40/27.5 |
| 3,596,744 | 8/1971 | Chesnokov | 194/319 |
| 4,437,558 | 3/1984 | Nicholson et al. | 198/397.04 |
| 4,441,602 | 4/1984 | Ostroski et al. | 194/318 |
| 4,448,297 | 5/1984 | Mendelsohn | 194/319 |
| 4,488,116 | 12/1984 | Plesko | 194/319 |
| 4,601,380 | 7/1986 | Dean et al. | 194/318 |
| 4,705,154 | 11/1987 | Masho et al. | 194/319 |
| 5,046,841 | 9/1991 | Juds et al. | 356/71 |
| 5,094,922 | 3/1992 | Ielpo et al. | 428/579 |
| 5,216,234 | 6/1993 | Bell | 235/494 |
| 5,293,980 | 3/1994 | Parker | 194/317 |
| 5,439,089 | 8/1995 | Parker . | |
| 5,630,288 | 5/1997 | Lasset et al. . | |

*Primary Examiner*—Robert P. Olszewski
*Assistant Examiner*—Bryan Jaketic
*Attorney, Agent, or Firm*—Diller, Ramik & Wight, PC

[57] ABSTRACT

A token for use with a token operated device includes a plurality of predetermined optical characteristics. The plurality of predetermined optical characteristics are disposed in a substantially radially symmetrical manner with respect to the token, and each of the optical characteristics have the property of a facet wherein an effective surface normal of said facet is a line along a predetermined vector angle with an elevational angle ranging preferably between 30° and 60°. An azimuthal angle of the facet surface is other than substantially along a radial line of the token or substantially along a line tangent to an annular ring centered on the token such that a token operated device can validate the predetermined optical characteristics substantially independent of token orientation. A token testing apparatus includes a chute defined by a field adjustable pair of spaced token edge guides spaced a predetermined distance from each other such that each token passing through the chute is sensed along its center.

21 Claims, 10 Drawing Sheets

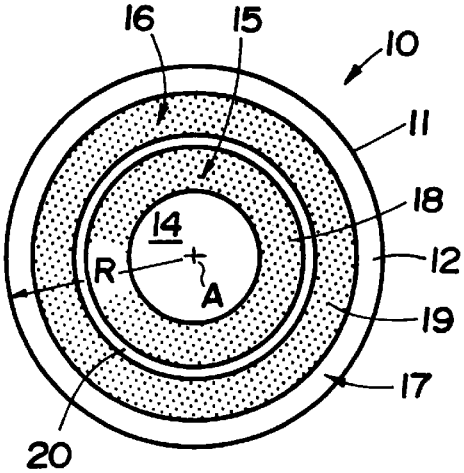
FIG. 5
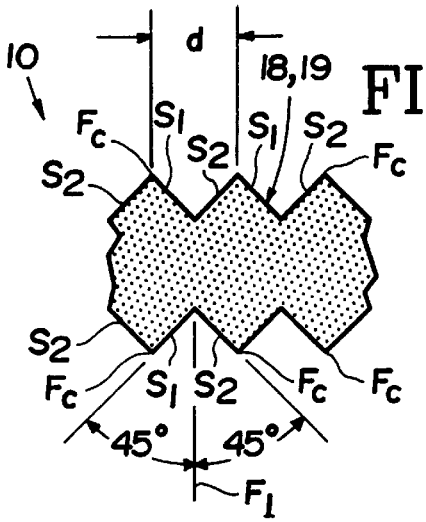
FIG. 7
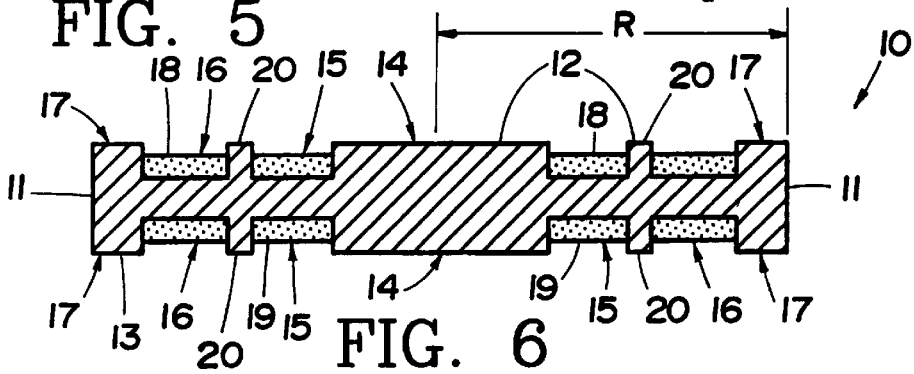
FIG. 6
FIG. 8
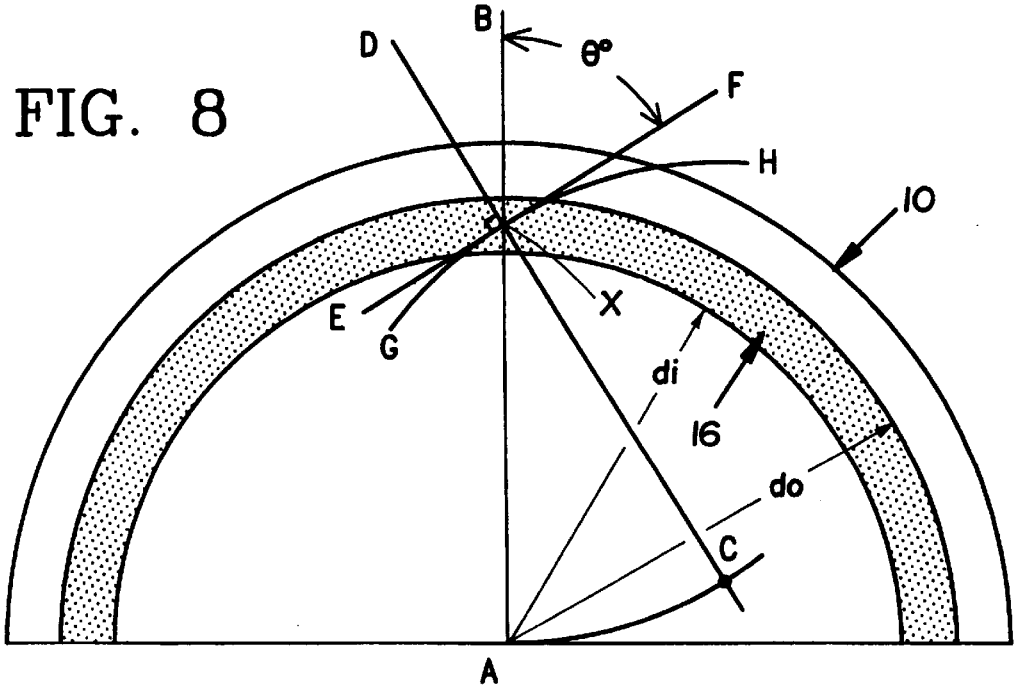

FIG. 13
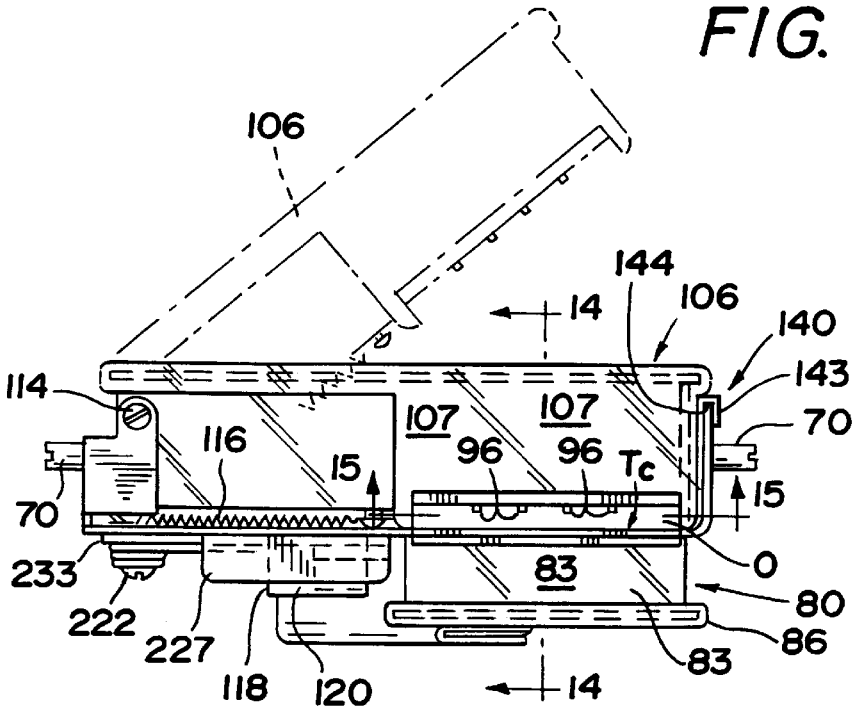
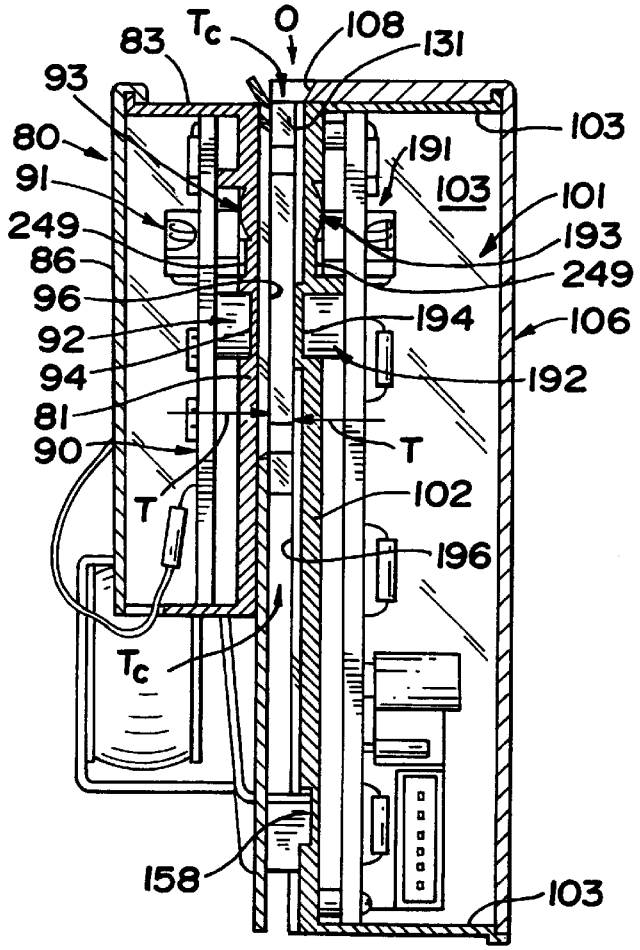
FIG. 14

Vcc
D1
1N4000
K1
77
R1
2.0K
Q1
PN2222
300
Vcc
U1
Microcontroller
Q2
PN2222
R2
300
Vcc
D2
SFH409
SFH309
Q3
PN2222
Q4
R3
10K
260,261
260
C1
.01uF
LM311
U2
+
−
Vref

TOKEN HAVING PREDETERMINED OPTICAL CHARACTERISTICS AND A TOKEN VALIDATION DEVICE THEREFOR

FIELD OF THE INVENTION

The present invention relates to token validation devices wherein the term "token" is intended to mean metal currency, coins, metal and non-metallic tokens or a combination thereof which function as a substitute for valid coins or currency, transparent or opaque tokens or a combination thereof, disk shapes being preferable, and inclusive in the term "token" is virtually any element used as a form of currency or as a substitute therefore.

1. Background of the Invention

The variety of "genuine" coins utilized in the marketplace is extremely diverse because each government makes an attempt to keep their own form of currency or value of exchange unique enough to distinguish from that issued by others. "Genuine" tokens utilized in the marketplace are also diverse for the same reason, namely, to allow one specific proprietor to distinguish its genuine token/tokens from the token/tokens of another. Such tremendous diversity in genuine coins and genuine tokens indirectly pressures manufacturers, be they governments or private individuals, to produce coin and token validation devices which are designed flexible enough so that they may be field configured to accept and validate (or invalidate) the widest possible variety of coins or tokens, genuine or counterfeit. To that end, the body of validation design knowledge and products are replete with methods for dealing with different metallurgies and sizes of coins. However, with the combination of increased world travel and increasing number of issuing establishments, particularly gaming casinos, there has become an ever increasing need for additional distinguishable characteristics to prevent cross-play of unwanted, though genuine, tokens, and the total accurate elimination of counterfeits. The ability of simple combinations of useful alloys and token sizes to satisfy the needs of the casino market has long been exhausted.

2. Description of Related Art

To address the market need for more distinguishable tokens, there have been two noteworthy developments in token fabrication technology. First, tokens with minted optical codes, such as those disclosed in U.S. Pat. Nos. 5,046,841 and 5,216,234, have been marketed for use with coin validation devices capable of reading such optical codes. Second is the development of bimetallic and trimetallic tokens in which an inner metal disk portion of the token is made of one metal/alloy which differs from the metal/alloy of one or more outer annular rings, as described in U.S. Pat. Nos. 5,094,922 and 5,630,288. While multi-metal tokens have long since made their debut in the marketplace, they have been primarily produced for ease of visual discrimination via the use of two differently colored metals. Although inductive sensing has long been used to validate metallic tokens of all types, there has been little done to take advantage of the multi-signature nature of multi-metal tokens.

In order to make minted optical codes practical, it is required that minted reflective facets be distributed in an annular band that is substantially radially oriented independent of token orientation so that tokens may be deposited in the coin validator without concern for radial orientation. The latter is disclosed, for example, in U.S. Pat. No. 5,046,841. However, this distribution causes the relative angular relationship of minted facets presented to an associated optical code reader of the validator, as the coin passes the optical code reader, to be dependent on the lateral offset of the coin path relative to optical code reader position. It can be mathematically shown that the token path with the least sensitivity to small variations in lateral offset is the token path which is centered on the optical code reader. In other words, the optimum token path of the token is the one wherein the center of the token is guided by the coin chute to pass over the center of the optical code reader. Similarly, in the case of multi-metal tokens, it is likewise true that the optimum path of token travel to take full advantage of the inductive signatures of the individual metal/metal alloy components arranged in concentric annular bands with respect to an associated token would be the one where the center of the token is guided by the coin chute to pass over the center of the inductive sensor and wherein the inductive sensor is physically small enough so that separate responses can be generated with respect to different metal alloy areas of the token. Accordingly, no matter the specifics of the sensors, be they inductive, light-sensitive (reflective or transmissive), or both, maximum sensitivity and accuracy is achieved when sensing is centered on a center line of a token path defined by the movement of the token center thereal-ong.

Thus, apart from the present disclosure, the importance of controlling the path of the token to ensure sensing is substantially coincident with the path of the token center lacks disclosure in known prior art, including not only the latter-noted patents, but such disclosures as found in U.S. Pat. Nos. 4,437,558; 4,441,602; 4,488,116; 4,601,380; 4,705,154; 3,596,744; 4,448,297; 5,293,980 and 5,439,089. Such patents disclose inductive sensors having a fixed reference relative to an edge of an associated token or coin which is forced against an edge of an associated chute or a chute which is fully encompassed/surrounded by a wound coil which automatically dismisses from consideration the lateral position of an associated token moving along the chute.

In addition to the issue of precise token sensing and the location of token sensors with respect to token travel, the present disclosure also resolves potential problems associated with purely annular or radial facets of the type disclosed in U.S. Pat. No. 5,046,841 and 5,216,234. Counterfeit tokens or counterfeit coins (slugs) can be produced with annular or radial facets by, for example, using a cutting tool and a common lathe to cut annular rings into the surface of a metal disk (slug) or by pressing a softer metal disk (such as a lead disk) into the surface of a "valid" or "genuine" coin or token and produce a mirror image of the annular facets thereof. Although a mirror image is created by the latter "counterfeit" pressing operation, symmetrical facet structures will in most cases produce mirror image facets that are the same as the original.

SUMMARY OF THE INVENTION

The present invention provides a novel and unobvious validation device having adjustable guide edges for selectively adjusting the width of an associated token chute to adapt the validation device for use with a wide variety of different token diameters such that the position of associated sensors are maintained substantially fixed along the center of the token chute and the center of the token passing therethrough. This arrangement provides for configuration flexibility in the field and the ability to optimally and reliably sense properties of the tokens that are substantially radially symmetrically disposed about the tokens.

Furthermore, the tokens include facets having skewed orientations that are other than 0° or 90° relative to a radial line which essentially eliminates the possibility of making counterfeit faceted tokens on a lathe or by pressing a soft metal against a valid token. Moreover, such facets are additionally arc-shaped or curved along their length relative to a chord associated with each facet. Accordingly, the combination of sensor location along token center travel and specifically angled, skewed and arc-shaped token facets virtually preclude simple forms of counterfeiting and assures repetitive and reliable validation.

In accordance with a preferred embodiment of the present invention, the sensors are desirably fixed relative to a token chute through which tokens travel with each token center travelling along a center line of a path of travel coincident with sensor detection. Preferably, sensors are located on the line of travel of the token center at opposite sides of the token chute as either optical sensors, inductive sensors, or pairs thereof which allow the detection of tokens having one or more annular bands of skewed facet optical codes and/or one or more bands of differing metal alloys. Thus, tokens travelling through the token chute can be accurately sensed optically and/or inductively.

Preferably, the plurality of facets associated with each token have the property of a facet wherein the effective surface normal of the facet is aligned along a predetermined vector angle with an elevation angle preferably between 30° and 60° and an azimuthal angle other than substantially along a radial line of the token or substantially along a line tangent to an annular ring centered on the token. Irrespective of the precise optical characteristics or the angles of the facets, each facet lies in an annular band substantially along a chordal line of the token with each facet being curved or arc-shaped with respect to its associated chordal line.

The validation device or apparatus includes a token chute having edge guides spaced a predetermined distance from each other corresponding substantially to the diameter of a token passing through the chute. The latter structure ensures that each token center moves along a path substantially one-half the distance between the edge guides. First token characteristic sensing means and/or second token characteristic sensing means are provided for sensing respective first and second token characteristics during token movement along the token path. The sensing means sense each token substantially along the token center whereby on-axis or on-center token sensing is effected. The latter sensing means are located on one side or both sides of the token chute, and the distance between the edge guides is changed by moving the edge guides toward each other without changing the point of token sensing, namely, along the center line of the centered token path of travel. Preferably, one of the first token characteristic sensing means senses an optical property of the token and the other of the token characteristic sensing means senses an inductive property of the token.

The token testing or validating device of the present invention also includes means for adjusting the thickness of the chute to accommodate testing tokens, coins or the like of different thicknesses.

The validation or testing apparatus of the present invention also includes opposite walls defining the chute of which at least one wall is constructed from transparent material, one of the sensing means includes a light source for emitting light toward a token passing through the chute, and the transparent wall includes an in-situ formed lens for directing light rays at a predetermined angle toward light-sensing means to thereby detect optical characteristic of associated tokens.

The token testing/validation device preferably includes one or more light sources, lenses and light-sensing means at each of opposite sides of the chute, and the sensing means can be selectively located to detect different optical characteristics (different codes) of different tokens.

In further accordance of the invention, a circuit is provided which is responsive to associated sensors for generating an acceptance output signal through a plurality of conductor pins of a circuit board. In order to facilitate direct interface of the token acceptor to a variety of token operated devices, such as slot machines, vending machines etc., provision is made within the token acceptor enclosure to include one of a variety of electric plug conversion adapters, each of which plug onto the plurality of conductor pins, and each of which provide a second connector specific to the needs of one of the token operated devices.

BRIEF DESCRIPTION OF THE DRAWINGS

FIG. 5 is a top plan schematic view of the token of FIG. 1, and illustrates a protective guard bead between the pair of annular bands of facets to provide protection thereof.

FIG. 6 is an enlarged axial cross sectional view taken through the axis of the token of FIGS. 1 and 5, and illustrates the relationship of the guard beads to the facets of the token.

FIG. 7 is a highly enlarged fragmentary cross sectional view taken through adjacent facets of any of the tokens of FIGS. 1–6, and illustrates details thereof.

FIG. 8 is a schematic fragmentary view of a geometrical layout of a token and a single annular facet band, and diagrammatically illustrates the geometry associated with laying out and fabricating the facets in the annular band.

FIG. 13 is a top plan view of the token testing apparatus, and in phantom outline illustrates the manner in which the front housing can be pivoted away from the rear housing to gain access to the interior of the token testing apparatus.

FIG. 14 is a cross sectional view taken generally along line 14—14 of FIG. 13, and illustrates light sensors and inductive sensors carried by the front and rear circuit boards, and curved lenses of the transparent chute-defining walls for focusing light rays to scan token facets as a token drops through the token chute.

DESCRIPTION OF THE PREFERRED EMBODIMENT

Figure 1:
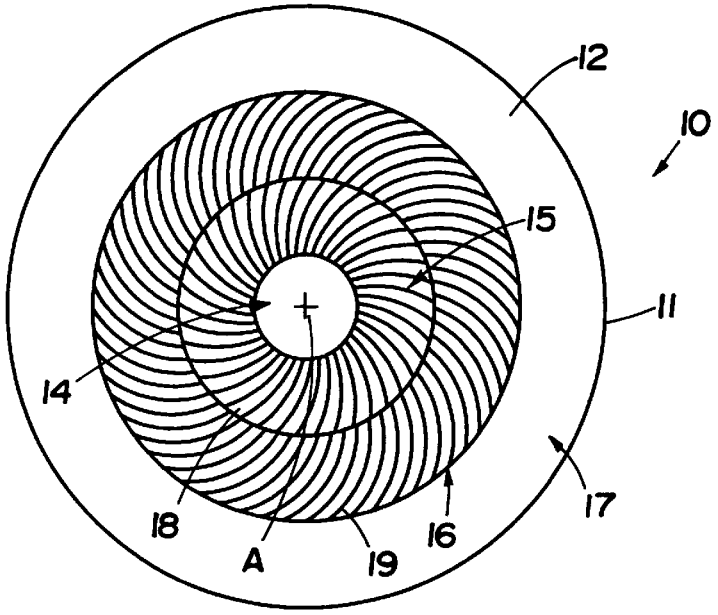
FIG. 1 is a top plan view of a token constructed in accordance with this invention, and illustrates two annular code areas or surfaces each provided with a plurality of skewed and arc-shaped facets therein.
Figure 2:
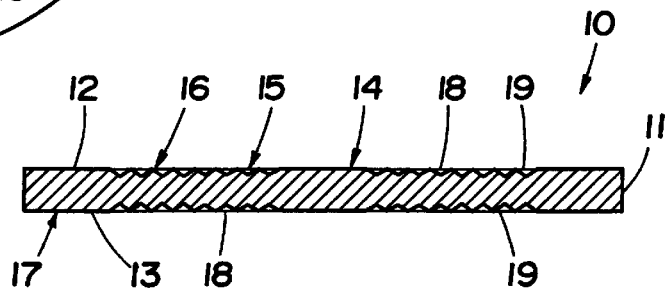
FIG. 2 is an enlarged cross sectional view taken through the center or axis of the token of FIG. 1, and illustrates opposite faces with the two annular code surfaces shown in FIG. 1 being replicated in a lower face of the token of FIG. 2.

A novel token constructed in accordance with this invention is illustrated in FIGS. 1, 2, 5, 6 and 7 of the drawings and is generally designated by the reference numeral 10.

The term "token" is used predominantly herein to mean genuine or valid metal currency, coins, metallic and/or nonmetallic tokens or disks or a combination thereof of the same or different alloys, or transparent or opaque tokens or a combination thereof which are a substitute for valid coins or currency, such as tokens used in casino slot machines or at gaming tables, or for car washes, automotive parking area gate opening acceptors, etc. Such "genuine" tokens are ofttimes counterfeited, thus at times herein the term "token" might well mean a counterfeit coin or counterfeit tokens, slugs of all kinds, and virtually any element used as a form of counterfeit currency. The context will clearly distinguish between a "genuine" token and a "counterfeit" token. Accordingly, the intent is that of not only providing a "genuine" token which can be readily, accurately and repetitively verified as such, but essentially cannot be easily reproduced and can be accurately distinguished from "counterfeit" tokens. However, throughout this disclosure the token 10 and other tokens disclosed herein will be described structurally and in terms of verification in the sense of being a "genuine" token.

The token 10 of FIGS. 1, 2, 5, 6 and 7 is preferably made from metal or metallic alloy material and is therefore totally opaque, and an outermost circumferential or peripheral surface 11 imparts a circular or disk-like configuration to the overall token 10. Opposite generally circular faces or surfaces 12, 13 of the token 10 define therebetween an innermost central circular portion 14 having a center or axis A which also defines the center A of the overall token 10, an innermost annular portion or band 15, a next innermost annular portion or band 16, and an outermost annular portion or band 17. The annular bands 14, 17 at each of the opposite faces 12, 13 lack any type of surface configurations which are specifically designed for detection/verification, although these surfaces can include desired indicia, such as the value of the token, the name/address of the "owner" thereof, such as a particular casino, the manufacturer, etc.

In keeping with the present invention, the token 10 includes in each of the annular portions, surfaces or bands 15, 16 a plurality of means 18, 19, respectively, in the form of reflective facets with each facet 18, 19 being defined by surfaces S1, S2 (FIG. 7) with each facet being inclined at substantially 45°(±2°) relative to the faces or surfaces 12, 13 and/or to a line F1 perpendicular to the faces or surfaces 12, 13. Each included facet corner Fc defined between adjacent surfaces S1, S2 includes a maximum radius of 0.005" and the distance d between adjacent facet corners Fc is 0.020" minimum and 0.025" maximum. The surfaces S1, S2 are polished to SPE/SP1 2 or better. Preferably the facet corners Fc defined by adjacent facet surfaces S1, S2 lie below a plane taken through the surfaces or faces 12, 13, and preferably an annular protective guard bead 20 (FIGS. 5 and 6) is located between the annular bands 15, 16 with a plane through the uppermost surface (unnumbered) of the guard bead 20 lying in the corresponding plane of the surfaces 12, 13. The guard beads 20 thereby protect the highly polished surfaces S1, S2 of the facets 18, 19 preventing abrasion, marring, dings, etc. The guard beads 20 on opposite faces 12, 13 of the token 10 also physically separate the annular bands 15, 16 such that the facets 18, 19 of the respective annular bands 15, 16 can be readily distinguished.

Each facet 18 or 19 is specifically oriented with respect to a radial line AB (FIG. 8) emanating from the center A of the token 10 and a line EF (FIG. 8) intersecting AB at point X of the particular band (16 in FIG. 8) under consideration. The radial line AB and the line EF define an included angle θ of 15° increments as measured in a clockwise direction relative to the radial line AB. The angle θ in FIG. 8 is approximately 60° [15°×4 (multiple)=60°]. This orients each facet in skewed relationship to the radial line AB. In other words, none of the facets 18 or 19 lie upon any radial line AB of the token 10, but instead are in substantially tangential relationship to a chord of the token 10, which cord corresponds to the angular orientation of the line EF. However, in accordance with the invention, each facet is not only skewed relative to radial line AB of the token 10, but the chordal relationship along the line EF is also curved or arc-shaped along a curved line or arc G-H which passes through the center point X of the band 16. In order to obtain the curved or arc-shaped line G-H, a line DC is drawn normal to the line EF passing through the center X and an arc AC is then drawn with the center X as the radius. The point C of intersection of the lines DC, AC becomes the axis for the arc-shaped line or curve G-H which passes through the center point X of the band 16. Thus, a 60° skewed (chordal) facet is defined substantially along the chord line EF but is also arc-shaped or curved along the curved or arc-shaped line G-H. This produces a single facet, and the token 10 must then be repositioned for fabricating the next succeeding facets by rotating the token about its axis A by a rotation angle RA defined by the equation:

$$RA = \mathrm{Tan}^{-1}\left\{\frac{d}{(AX)(\cos\theta)}\right\}$$

where d is the perpendicular distance between adjacent facet corners or peaks Fc (FIG. 7) and AX is the length along the radius R or the radial line AB between the token center A and the annular band center X of the annular band 16.

The peak to peak perpendicular facet distance d must be chosen so that 360° is evenly divisible by the rotation angle (RA). Thus, no matter whether the facets 18 are formed in the annular band 15 or the facets 19 are formed in the annular band 16, as just described, characteristic of all of the facets 18, 19 is their skewed (chordal) orientation disposed substantially along a chord which is also curved with respect to an arc passing through a center point X midway between the inner and outer diameters, di and do, respectively (FIG. 8), of the specific annular band involved.

Figure 3:
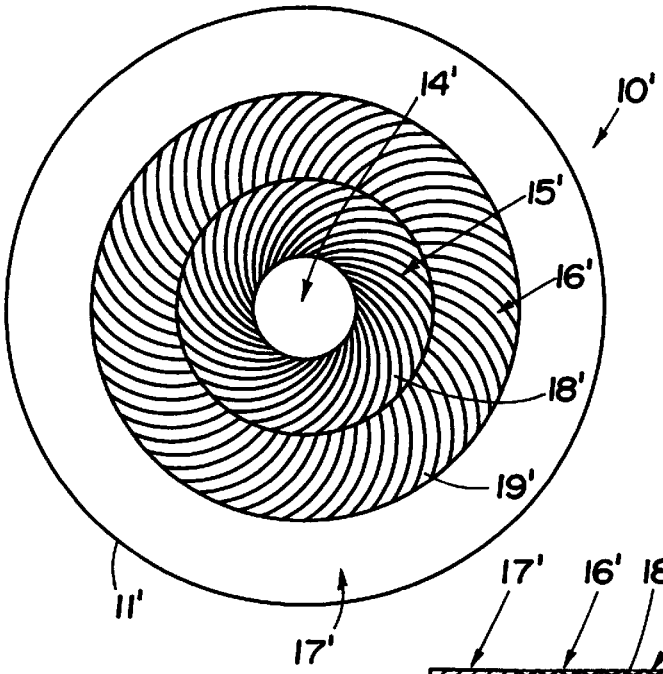
FIG. 3 is a top plan view of another token constructed in accordance with this invention, and illustrates a central circular disk formed from a metallic alloy, an annular metallic ring having a plurality of skewed and arc-shaped facets therein, an annular ring of transparent material having a plurality of arc-shaped facets therein, and an outermost annular metallic alloy ring.
Figure 4:
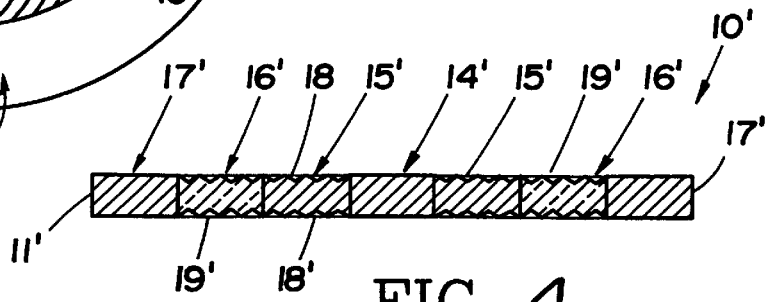
FIG. 4 is an enlarged cross sectional view taken through the axis of the token of FIG. 3, and illustrates the various component thereof including facets in both upper and lower faces of the innermost two annular rings of the token.
Figure 9:
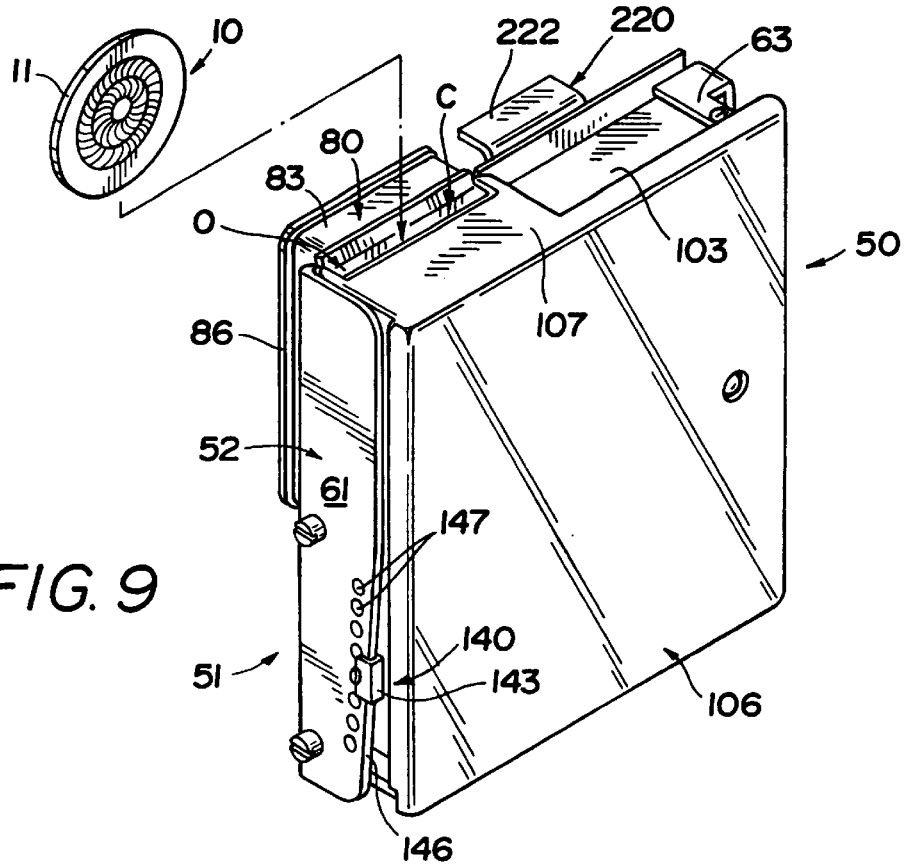
FIG. 9 is a front perspective view of a novel validation device or apparatus for testing tokens in accordance with the present invention, and illustrates a token positioned for descent through a chute formed between opposite pivotally connected front and rear housings of the validation device.

Reference is made to another token 10' of FIGS. 3 and 4 which has identical though primed reference numerals applied thereto to identify structure corresponding to that heretofore described relative to the token 10. However, the token 10' is constructed not as a one-piece metallic alloy token, such as the token 10 of FIGS. 1, 2, 5, 6 and 7, but instead an innermost central circular portion 14' is a disk of metal or metal alloy surrounded by another annular band 15' of metal (opaque) material, which in turn is surrounded by a transparent annular band 16' of plastic material and in turn is surrounded by an annular band of metallic material or a metallic alloy 17' which differs in its inductive signature from that of the metallic disk 14'. As will be noted further herein, the metallic alloy disk 14' and the annular metallic band 17' can be sensed/tested inductively whereas the annular bands 15', 16' can be tested or sensed optically reflectively (opaque) and optically transmissive (transparent), respectively, while the metallic alloy annular band 15' can also be sensed inductively. However, the respectively opaque and transparent facets 18', 19' are constructed in accordance with the description of the fabrication of the facets heretofore described specifically relative to FIG. 8.

As may be appreciated from the foregoing descriptions, there are numerous possible code configurations and embodiments possible based upon relative location of the bands, number of annular bands, skew angle of facets in the bands or metal composition of the bands, and implementation of the facets, be they reflective, refractive, or diffractive.

A novel apparatus or device for testing and/or validating tokens, such as the tokens 10, 10' or the equivalent thereof, is fully illustrated in FIGS. 9–19 of the drawings, and is generally identified by the reference numeral 50. The token testing apparatus or validation device 50 includes a rear housing 51 and a front housing 101 (FIGS. 9–13).

Figure 10:
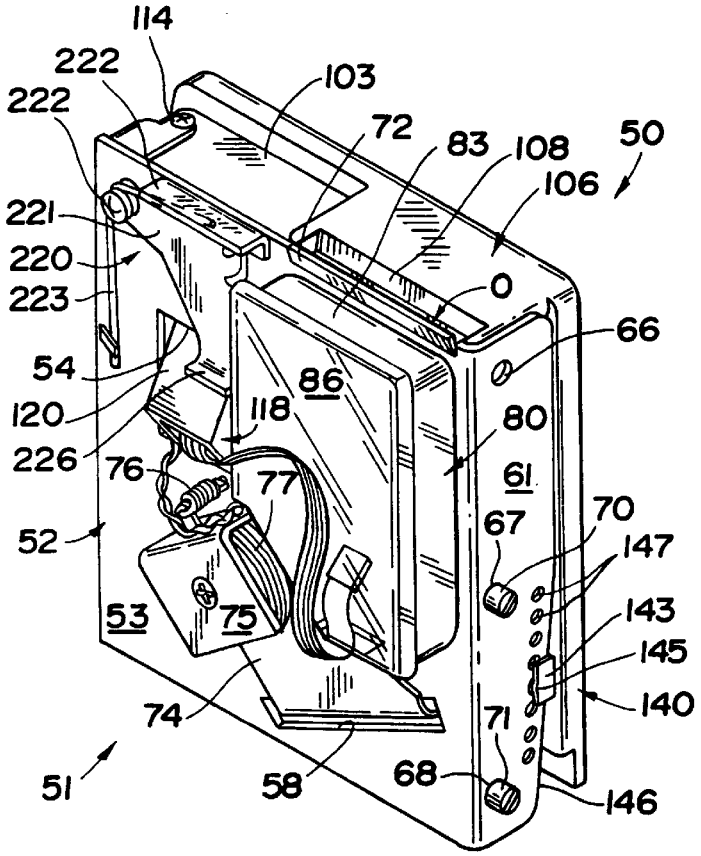
FIG. 10 is a rear perspective view of the token testing apparatus of FIG. 9, and illustrates the rear housing carrying a rear circuit board/sensing housing, a coil for actuating a gate, an opening in a metallic mounting plate of the rear housing, a pivotally mounted spring-biased cam and a cam surface portion of the front housing projecting through the opening to release token jamming, and a step adjustment mechanism between the front and rear housings for accommodating tokens of different thicknesses.
Figure 11:
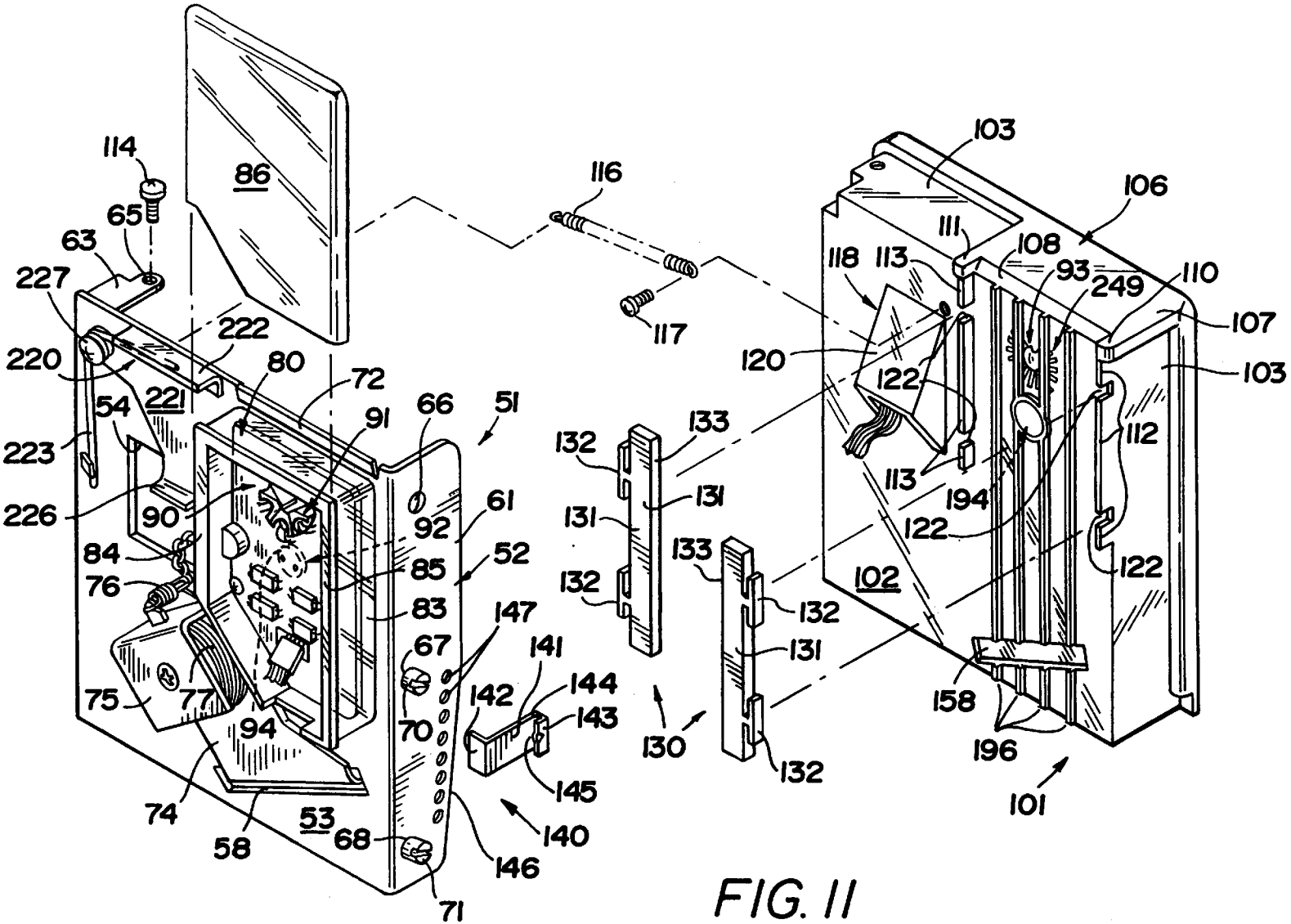
FIG. 11 is an exploded perspective view of the token testing apparatus of the invention, and illustrates a transparent cover exposing a rear circuit board of the rear housing carrying a light source, light sensing means and a sensing coil adjacent a transparent token chute-defining wall, a similar transparent token chute-defining wall of the front housing having focusing lens and a pair of interchangeable edge guides for adapting the token testing apparatus for testing tokens of different diameters.
Figure 12:
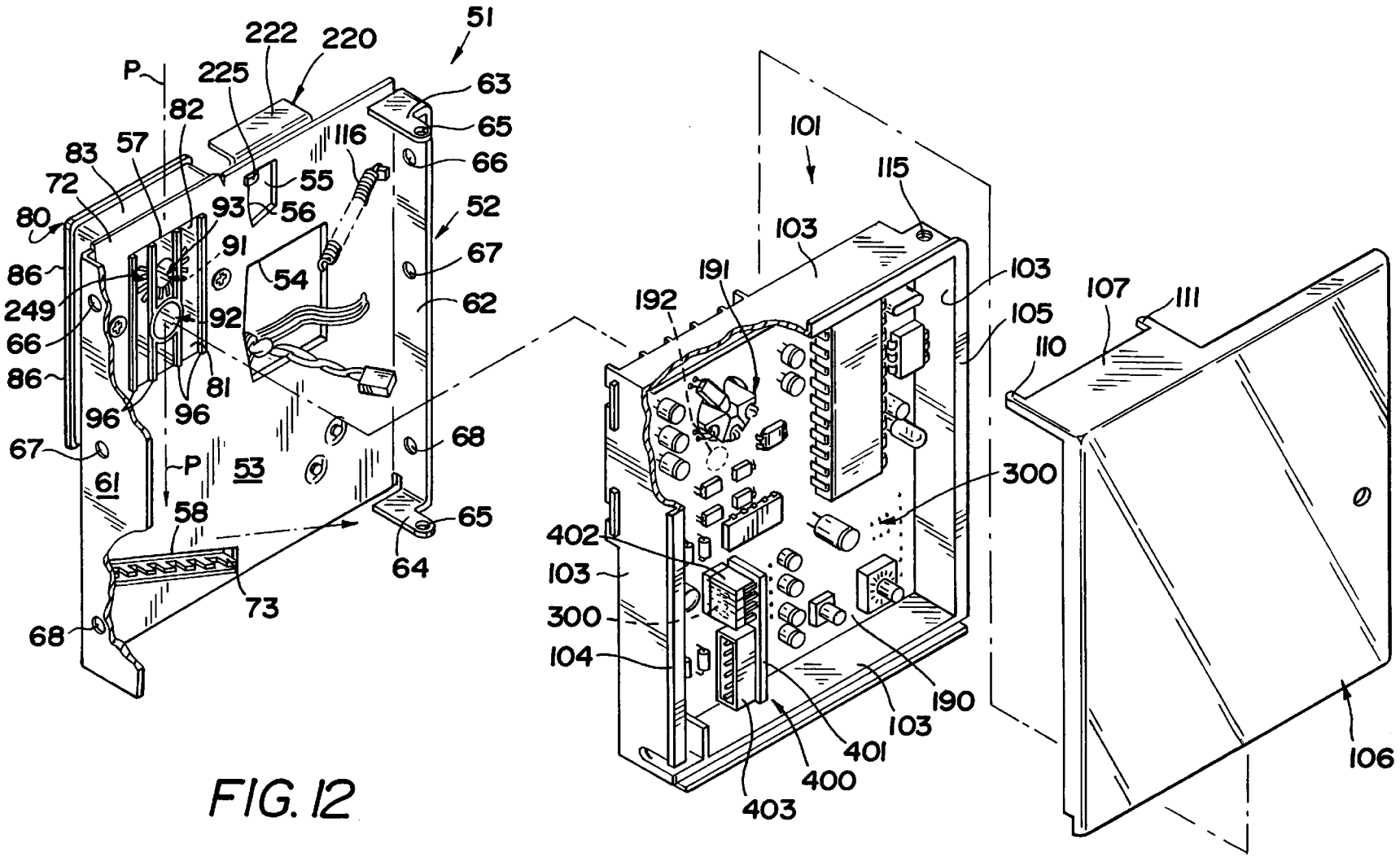
FIG. 12 is an exploded perspective view of the token testing apparatus, and illustrates interiors of both the rear housing and the front housing, a main circuit board carried by the front housing carrying a light source, light sensors and a sensing coil, and a transparent front cover which is slidably removed from and applied to the front housing.

The rear housing 51 includes a main mounting and support plate 52 (FIGS. 9–12) constructed from relatively rigid though bendable metallic material which includes a relatively polygonal or rectangular rear wall 53 having formed therein a square or polygonal opening 54 (FIG. 12), thereabove a generally polygonal opening 55 having an arcuate surface or edge 56, a rectangular opening 57 (FIG. 12), and a narrow inclined rectangular opening 58 (FIGS. 10–12). The support plate 52 includes laterally spaced side walls 61, 62 bent into generally parallel relationship and with the side wall 62 being further bent at upper and lower ends (FIG. 12) into flanges 63, 64 having identical pivot pin receiving openings 65. The side walls 61, 62 also include three identical threaded openings 66 through 68 (FIG. 12) into any two of which can be threaded screws 70, 71 (FIGS. 9–11 and 13). The screws 70, 71 are shown threaded into the respective threaded openings 67, 68 of each side wall 61, 62 which adapts the token testing apparatus or token validation device 50 to be snap-fit into bayonet slots (not shown) of a compatible bracket of a token operated device (also not shown), such as a casino slot machine. The bayonet slots of such a casino slot machine permit the validation device 50 to be readily snapped into and removed from the bracket. Brackets for different token operated devices typically have slots located at two of the three different positions, thus the reason for the three threaded holes 66–68 in each of the side walls 61, 62. The screws 70, for example, can be removed from the threaded openings 67 and then can be threaded into the openings 66 to accommodate the validation device 50 for utilization with a different slot machine with a bracket having differently spaced bayonet slots.

Figure 15:
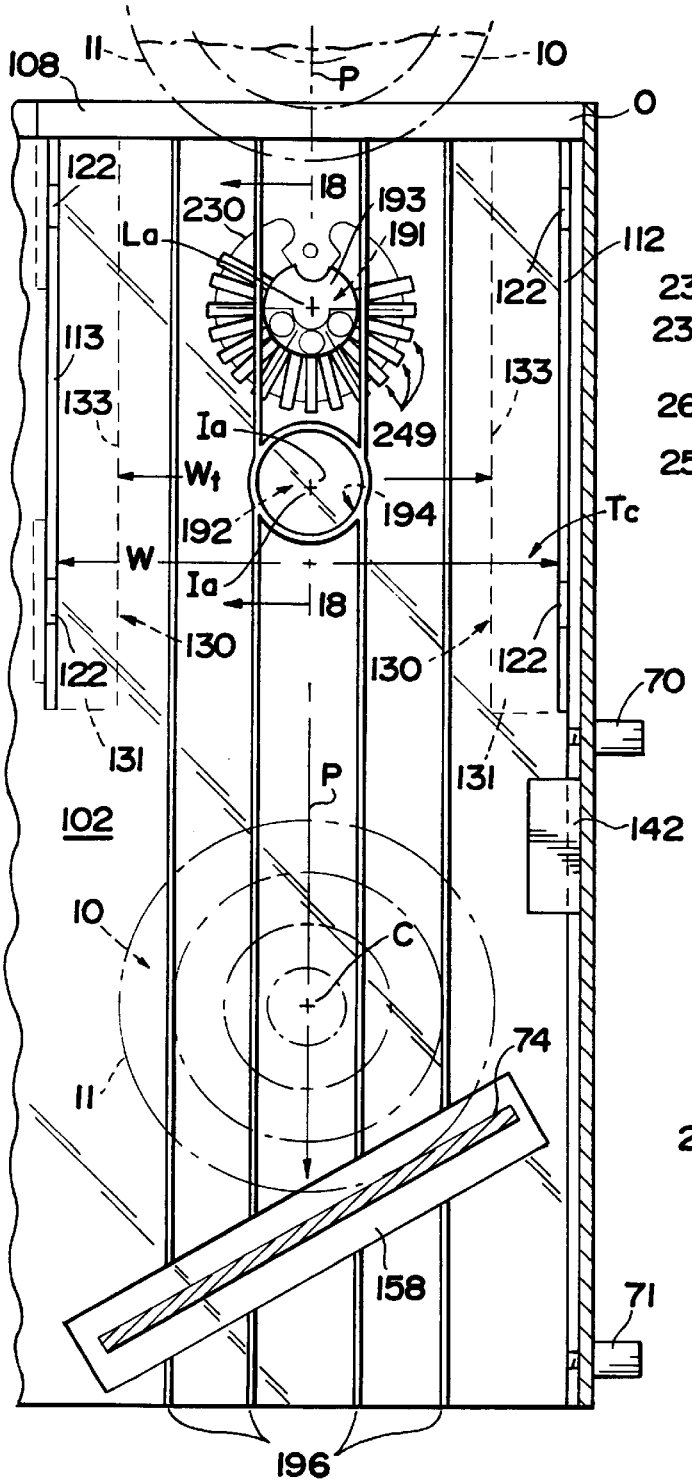
FIG. 15 is a highly enlarged cross sectional view taken generally along line 15—15 of FIG. 13, and illustrates the location of the light source, light sensors, lens and the inductive sensor or coil essentially along a token path center line defining the center of the token/coin chute along which travels the axis of each token guided during its descent by the opposite edge guides of the token chute.
Figure 16:
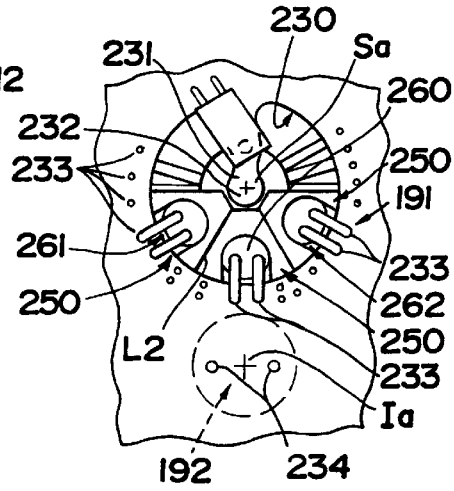
FIG. 16 is a fragmentary front elevational view of a light and inductive sensing area of the main or front circuit board with the construction of the rear circuit board sensing area being identical, and illustrates a light source carried by a light source holder and a pair of detectors carried by a pair of identical detector holders fit into a substantially circular opening of the circuit board.
Figure 17:
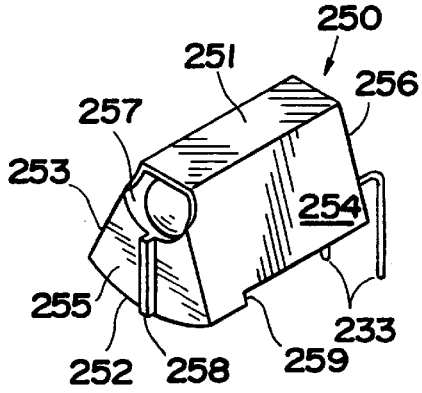
FIG. 17 is a perspective view of one of several identical light source and detector or sensor holders, and illustrates the generally pie-shaped or wedge-shaped configuration thereof.

An upper edge portion 72 of the support plate 52 is bent outwardly and in part defines an entrance opening O at the top of the validation device 50 (FIGS. 9, 10 and 13) through which the token 10 (FIG. 9), for example, can be inserted/dropped for travel along a generally vertical token path of travel identified by the vertical headed arrow P in FIGS. 12 and 15. The center C of the token 10 is guided in a manner to be described hereinafter substantially centered along the token path of travel P and the token path of travel P lies substantially along the centers of optical and inductive sensing means with such accurate movement of the token 10 along the path P being controlled by a pair of guide edges or guide ribs (112, 113; 131, 131 in FIG. 11) which are in turn spaced from each other a distance substantially that of the token diameter, as will be described more fully hereinafter.

Counterfeit tokens descending along the token path of travel P are sensed not to be valid, strike a plurality of fingers 73 of a pivotally mounted gate 74 which project through the slot 58, and are angulated or inclined to deflect invalid/counterfeit tokens to the right, as viewed in FIG. 12, along the dot/dash headed arrow associated therewith. The gate 74 is pivotally mounted to a bracket 75 which is in turn connected to the rear wall 53 of the support plate 52. The pivotally mounted gate 74 is biased by a spring 76 to the position shown in FIGS. 10 and 12 with the fingers 73 thereof projecting through the opening 58 and into the token path of travel P to deflect invalid, fraudulent and/or counterfeit tokens or coins to the right, again as viewed in FIG. 12. However, upon the sensing of a valid token or coin 10, through appropriate sensing means, circuitry, etc. to be described hereinafter, a coil 77 secured to the bracket 75 is energized and draws the gate 74 against the bias of the spring 76 pivoting the gate fingers 73 out of the token path of travel P and valid/genuine tokens 10 continue vertical descent therealong into an appropriate receptacle (not shown) of the acceptor mechanism (slot machine or the like).

A rear sensing and circuit housing 80 is constructed of transparent plastic material and includes a bottom wall 81 (FIGS. 12 and 14) of which a rectangular portion 82 is aligned with the rectangular opening 57 (FIG. 12) of the rear wall 53. A peripheral wall 83 of the rear sensing and circuit housing 80 has oppositely directed flanges 84 and 85 (FIG. 11) for matingly, slidingly engaging opposite side channels (not shown) of a transparent cover 86 which can be removed from the position shown in FIGS. 9 and 10 by simply sliding the cover 86 upwardly to the position shown in FIG. 11 and vice versa. A circuit board 90 (FIGS. 11 and 14) is supported in substantially spaced parallel relationship to the transparent rear wall 81, and the circuit board 90 carries first token characteristic sensing means 91 (FIGS. 11, 12 and 14) for sensing a first token characteristic during token movement along the token path P and second token characteristic sensing means 92 for sensing a second token characteristic during token movement along the token path P. The first sensing means 91 includes an optical sensing system which includes as part thereof in situ lens means 93 (FIGS. 12 and 14) and a plurality of optical element holder detents 249 arcuately spaced 15° from each other in a "sunburst" pattern in situ molded during the molding of the housing 80 in the rectangular portion 82 of the bottom wall 81 thereof. The rectangular portion 82 of the bottom wall 81 also has integrally in situ molded therein a shallow cylindrical cup-shaped recess 94 (FIG. 14) in which bottoms or seats the second token characteristic sensing means 92 which is a conventional inductive sensing coil. The specifics of the circuit board 90, the sensing means 91, 92 and the lens 93 will be described more fully hereinafter.

The bottom or rear wall 81 (FIG. 14) also includes four relatively narrow parallel ribs 96 (FIGS. 12 and 13) which project into and through the rectangular opening 57 (FIG. 12) and are essentially in parallel relationship to the token path of travel P. The ribs 96 provide minimal contact with each token 10 during its descent and prevent scuffing of the optical surfaces by the passing token.

The front housing 101 is constructed substantially entirely from transparent material and includes a front wall 102 (FIGS. 11, 14 and 15), and a peripheral wall 103 including opposite vertical side walls (unnumbered) having oppositely directed flanges (104, 105) which slidably mate with channels (unnumbered) of a transparent front cover 106 (FIGS. 9, 10, 11, 12 and 14) which can be removed by sliding upwardly from or reinserted by sliding downwardly upon the flanges 104, 105. An upper rearwardly projecting portion 107 of the front cover 106 includes a tapering slot or groove 108 and two rearwardly projecting fingers 110, 111 which are in generally parallel relationship to each other. With the transparent cover 106 closing the front housing 101, the projecting fingers 110, 111 thereof are in overlying protective relationship to uppermost end portions (unnumbered) of the respective token edge guides or ribs 112, 113 (FIG. 11). The distance between the ribs 112, 113 establishes the maximum diameter of a token 10 which can pass through the validation device 50 when the housings 51, 101 are closed relative to each other, as is illustrated in FIGS. 9, 10, 13 and 14 of the drawings. The front housing 101 is preferably pivotally secured to the rear housing 51 by identical screws 114 (FIGS. 10 and 11) passing through the openings 65 of the flanges 63, 64 and threaded into threaded openings 115 (FIG. 12) in upper and lower corner walls (unnumbered) of the peripheral wall 103. A spring 116 (FIGS. 11–13) is conventionally secured to the rear wall 53 (FIG. 12) of the rear housing 51 and by a screw 117 (FIG. 11) to the front wall 102 of the front housing 101 which normally holds the housings 51, 101 closed (FIGS. 9, 10, 13 and 14), though pivoting movement to an open position, as shown in phantom outline in FIG. 13, for inspection and to relieve token jamming is readily accommodated.

The entire front housing 101, excluding the front cover 106 and a circuit board 190, is of a one-piece molded plastic construction, preferably copolymeric/polymeric synthetic plastic material, such as transparent polycarbonate. Integrally molded as part of the overall front housing 101 and principally the front wall 102 thereof are four generally parallel ribs 196 (FIGS. 11 and 15), an inclined rectangular recess 158 (FIGS. 11, 14 and 15), a wall portion 118 having a cam or camming surface 120, lens means or lens 193, a circular cylindrical cup-shaped recess 194 (FIGS. 11, 14 and 15) and slots or recesses 122 (FIGS. 11 and 15) in the token edge guides 112, 113. The ribs 96, 196 are vertically aligned in opposing spaced pairs 96, 196; 96, 196, etc. and defined therebetween a token chute TC (FIGS. 13–15) extending vertically downwardly from the opening O along which the tokens 10 pass during sensing, detection, validation and sorting (acceptance/rejection).

It is highly desirable to alter a variety of the physical characteristics of the validation device 50 in the field, as for example, changing the width W (FIG. 15) of the token chute TC, as measured normal to the guide ribs 112, 113, and the depth or thickness T (FIG. 14) of the token chute TC, as a measurement of the space between the ribs 96, 196 to accommodate coins/tokens 10 of different thicknesses.

As is best illustrated in FIGS. 11 and 15 of the drawings, chute width changing means 130 are provided for changing the perpendicular distance between the edge guides 112, 113 while at the same time maintaining the center of token path P of the token chute TC centered on sensing means 91, 92, 191 and 192. In FIG. 15 the normal distance between the edge guides 112, 113 corresponds to the maximum diameter of a token 10 which can pass along the token chute TC and be essentially guided by the edge guides 112, 113. In FIG. 15 a relatively small diameter token 10 is illustrated and if unguided the same would not fall with its center A maintained substantially coincident to the path P because its peripheral edge 11 would not contact the edge guides 112, 113. However, by utilizing the chute width changing means 130, the width or distance W can be changed and specifically changed equal distances from each of the ribs 112, 113 so that no matter the diameter of the token 10 its center A will at all times descend along and in coincidence with the center line path of travel P of the token which, of course, lies along the centers of sensing of the sensing means 91, 92 and 191, 192.

The chute width changing means 130 is in the form of equally sized edge guides members, ribs or bars 131 (FIG. 11) of one-piece injection molded polymeric/copolymeric synthetic plastic material each having pairs of connecting bars or fastening detents 132 opposite guide surfaces 133 of the guide ribs 131. Since the width of the guide ribs 131 are the same, when each guide rib 131 is snap-secured with its fastening detents 132 in the slots 122, the width W of the token chute TC (FIG. 15) is reduced identical distances from each side and thus each guide surface 133 is spaced an identical distance from the token sensing center line or token path P and sensing again will occur along the token center A as the token 10 descends through the token chute TC. In FIG. 15, a pair of the guide ribs 131 are illustrated in phantom outline snap-secured by the fastening detents 132 in the slots 122 of the guide ribs 112, 113. This places the guide ribs or guide bars 131 with their opposing surfaces 133 a distance Wt from each other which corresponds to the diameter of the token 10 illustrated in FIG. 15. Each of the surfaces 133 is, of course spaced substantially the exact distance from the token center line path of travel P, and thus the token 10 will descend with its peripheral edge 11 contiguous the guide surfaces 133, 133 as a consequence of which its center A is in coincidence with the path P. Obviously, the thickness of the bars 131, 131 can be varied but varied equally so that no matter the pair of bars snap-inserted into the slots 122, the distance between each guide surface 133 and the path P of token axis travel is identical. Thus, edge guides, ribs or bars 131 of lesser or greater width than those illustrated in FIGS. 11 and 15 can be similarly utilized to readily and rapidly field-change the width of the token chute TC to accommodate validation of tokens 10 of differing diameters, again without altering in any fashion sensing by the sensing means 91, 92, 191, 192 along the center A of the token 10, or any other tokens of differing diameters, as they descend along the center line P through the token chute TC.

The means for selectively varying the thickness T of the token chute TC to accommodate tokens 10 of different thicknesses is generally designated by the reference numeral 140 (FIGS. 9, 10, 11, 13 and 15) and includes a substantially L-shaped or J-shaped member defined by a central portion 141, a leg 142 normal thereto, and a return radius portion 143 defining a channel (unnumbered) having an innermost or bight surface 144. A locking detent 145 projects toward the central portion 141. The side wall 61 of the rear housing 51 includes a downwardly tapering edge 146 (FIGS. 9–11) along which are located a plurality of circular openings 147 equally spaced from each other. The member 140 is slipped upon the side wall 61 such that the central portion 141 is innermost and the detent 145 is outermost with the bight surface 144 contacting the edge 146. The front wall 102 of the front housing 101 abuts against the flange 142 (FIG. 15) and is held in this abutting position by the spring 116. Since the edge 146 is tapered toward the bottom of the side wall 61, the depth or thickness T of the token chute TC will be established at a minimum when the detent 145 is in the lowest of the openings 147, whereas the thickness T of the token chute TC will be the greatest when the detent 145 is in the highest of the openings 147. Thus, by selectively moving the thickness adjusting member 140 along the edge 146 and positioning the detent 145 selectively in one of the openings 147, the inwardly spring-biased pivoting position of the front housing 101 is fixed which in turn essentially fixes the distance T between the ribs 96, 196 (FIG. 14) to accommodate the token chute TC for tokens of different thicknesses, again absent any change in center-line sensing as tokens of virtually any thickness descend along the center line path or center line token sensing path P.

As will ofttimes occur, tokens 10 can jam within the validation device 50 during descent through the token chute TC for a variety of reasons, and in order to unjam tokens and restore operation absent damage to the validation device 50 or any of its components, means generally designated by the reference numeral 220 (FIGS. 10 and 11) are carried by the plate 52 of the rear housing 51 for cooperation with the camming surface 120 of the wall portion 118 of the front wall 102 of the front housing 101. The anti-jamming means 220 includes a metallic plate 221 pivotally connected by a pivot 222 to the wall 53 and is spring-biased to the position illustrated in FIGS. 10 and 11 by a conventional torsion spring 223 having an end (unnumbered) bearing against the underside of a finger tab 227. A guide tab 225 (FIG. 12) is struck from the plate 221 and projects into the opening 55 in riding overlying relationship to the back side of the plate 53 along the edge 56 of the opening 55 (FIG. 12). A cam portion 226 of the plate 221 is located just below an upper edge (unnumbered) of the opening 54 and in alignment with the cam surface 120 of the front housing 101 when the validation device 50 is closed (FIG. 10). The wall portion 118 projects a substantial distance through the opening 54 of the wall 53 (FIG. 10) when the housings 51, 101 are closed, and therefore a substantial portion of the camming surface 120 similarly projects rearwardly beyond the cam 226 of the plate 221. If tokens jam the token chute TC, the finger tab 227 is simply depressed which pivots the plate 221 clockwise (FIG. 10) bringing the cam portion 226 down against and along the camming surface 120 causing the front housing 101 to progressively pivotally open about the pivot pins 114 and against the bias of the spring 116 thereby widening/opening the token chute TC and releasing jammed coins/tokens therein.

Reference is now made specifically to FIGS. 15–18 of the drawings which illustrates details of cooperative means 230, 250 for mounting the sensing means 191, 192 relative to the associated circuit board 190, and the structure hereinafter immediately described applies equally to the sensing means 91, 92 and the circuit board 90 thereof. The circuit board 190 includes a locating and mounting opening 230 which is circular except for a generally radial leg 231 descending from the twelve o'clock position of the locating and mounting opening 230 and terminating in a rounded end 232 which includes an axis Sa which is the axis of the opening 230 and also lies on the token centerline path P along which the center A of each token 10 descends as it moves through the token chute TC under the influence of gravity (FIG. 15). A plurality of lead openings 233 are formed through the circuit board 190 for purposes to be described more fully hereinafter. A pair of lead openings 234 are also formed through the circuit board 190 into which project leads 235 of the cylindrical inductive coil 192 having an end (unnumbered) received in the recess 194 of the front wall 102 (FIG. 18) of the front housing 101. A central axis Ia defines the axis of the inductor 192 which also lies on the axis of token travel defined by the path axis P.

Figure 18:
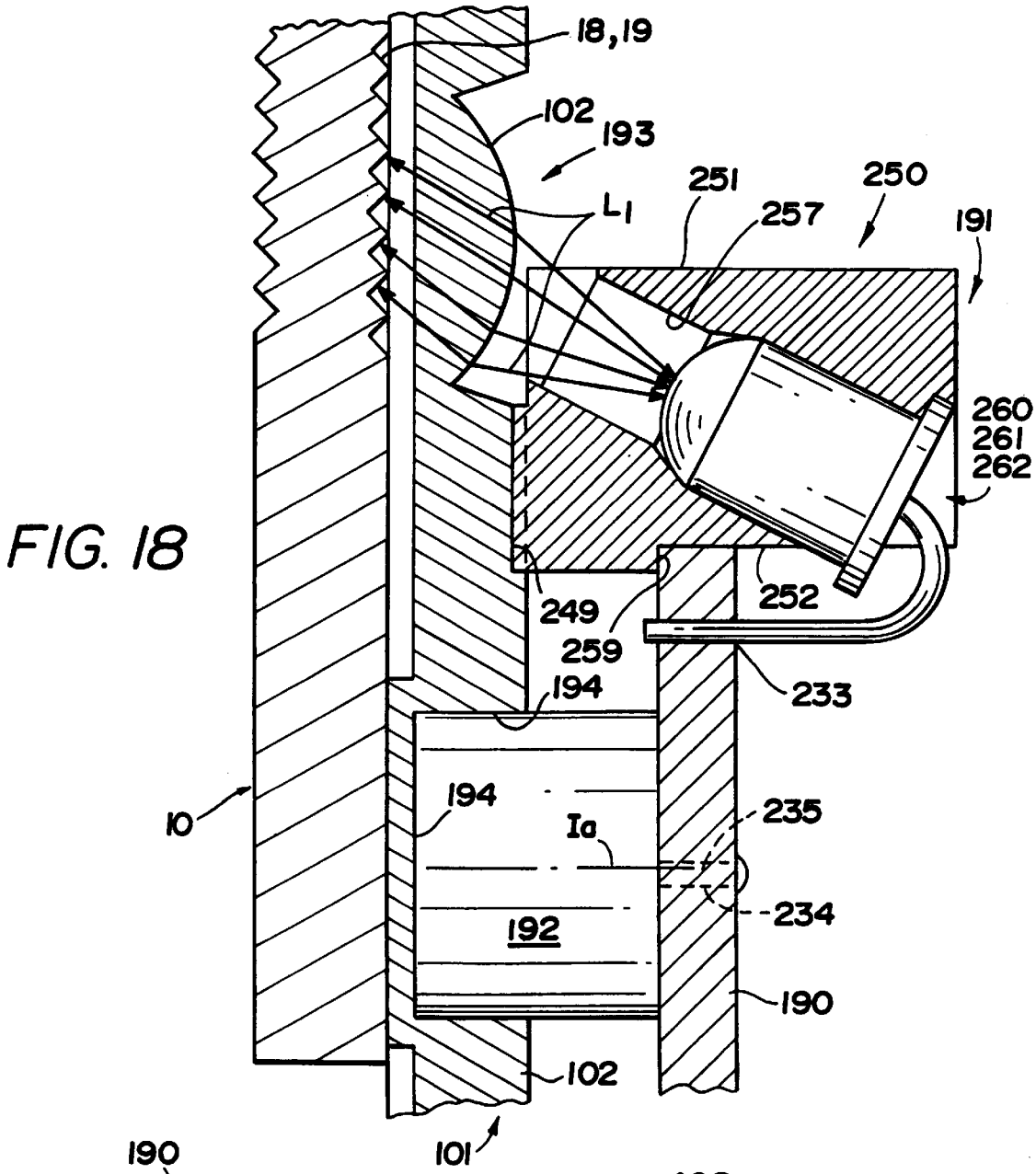
FIG. 18 is a highly enlarged cross sectional view taken generally along line 18—18 of FIG. 15, and illustrates the manner in which light rays are focused by lens upon and reflected by lens from facets of the token for sensing/validating the same depending upon specific facet or code parameters.
Figure 19:
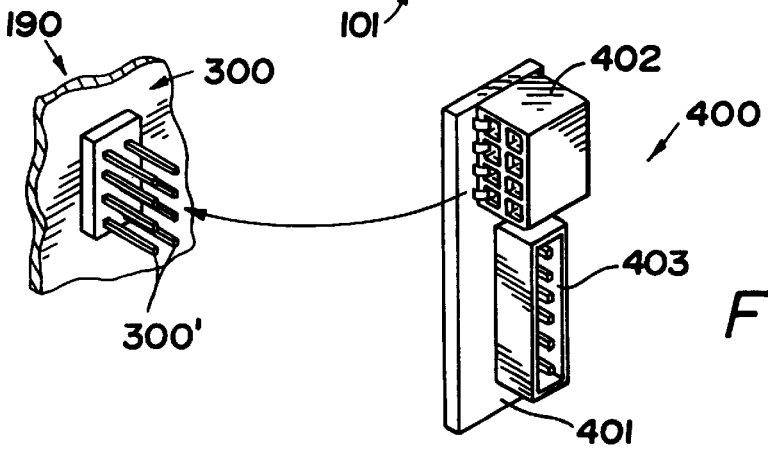
FIG. 19 is a fragmentary perspective view of a portion of the main circuit board, and illustrates a plurality of conductor pins thereof to which can be selectively plugged any one of several electrical converter plugs to accommodate the testing of a specific token associated with a specific acceptor mechanism, such as a specific casino slot machine of a specific manufacturer to accommodate the required physical and electrical connector interface associated with a specific brand or style of slot machine or vending machine.

The locating and housing opening 230 of the circuit board 190 houses at least two holding means or holders 250, one for carrying a source of radiant energy and the other for carrying a radiant energy detector, but irrespective of the number of radiant energy detectors employed, which can vary, the holders 250 for both the radiant energy source and the radiant energy detector or detectors is identical. Each holder 250 (FIG. 17) is generally of a pie-shaped or wedge-shaped configuration having a narrowest innermost radial face 251 which can be substantially flat or slightly concavely curved, a radially outboardmost larger convexly curved surface 252, converging/diverging faces 253, 254 and end faces 255, 256 through which pass a bore/counterbore 257. A radial foot 258 projects from the end surface 255 and functions to abut against and seat in an accurately located slot 249 (FIGS. 15 and 16) of the transparent wall 102 to accurately locate the holder in the opening 230 and also relative to the lens means 193, as will be described more fully hereinafter. The seating of one such radial foot 258 relative to a radial locating slot 249 of the wall 102 is illustrated in FIG. 18. A circumferential ledge 259 seats against the opposite surface (unnumbered) of the circuit board 190, as is shown in FIG. 18. Thus, the radial foot 258, the radial locating slot 249, and the circumferential ledge 259 accurately locate each holder 250 spatially with respect to the lens means and the path P.

The bore 257 of each holder 250 is precisely bored and counterbored (FIG. 18) to accurately receive and locate therein at least one light source emitting or generating means 260 (6 o'clock position in FIG. 16) and at least one light source sensing means 261 (8 o'clock position in FIG. 16), though further light sensing means 262 (4 o'clock position in FIG. 16) can be provided to collectively sense multiple bands 15, 16 (FIGS. 1 and 2) of facets 18, 19, respectively, arcuately spaced differing from each other by at least 15°, as was earlier described. The light generating means 260 can be a conventional light emitting diode, such as a Siemens SFH 409 infra red LED in a T-1 plastic package, whereas the sensing means 261 and/or 262 is a matched photodetector, such as a Siemens silicon NPN phototransistor model SFH 309. Pairs of leads (unnumbered) of the light emitting diode 260 and the phototransistor 262, 263 are inserted in the lead openings 233, soldered and define portions of verification circuitry generally designated by the reference numeral 300 in FIG. 20 of the drawings which will be described more fully hereinafter. Suffice it to say that the axis Sa corresponds to the axis of development of the lens 193 or the lens axis La (FIG. 15), and as light is emitted from the light source emitting means 260 (FIG. 16) it passes through lens 193 but the light reflected back from the facets 18, 19 of a particular token 10 will only be received by the phototransistor 261 or 262 if the reflective facets of token 10 are perpendicular to a line L2 bisecting the optical axes of the light source and light detector 260, 261, as viewed in FIG. 16, and perpendicular to the parallel rays emanating from far side of in situ molded lens 193 toward the token 10, as viewed in FIG. 18. Thus, as is best illustrated in FIG. 18, the curvature (unnumbered) of the lens 193 depicts light travelling through the lens 193, being refracted thereby to impinge upon the facets 18, 19 at a 90° angle thereto and being reflected from each token facet once again back along line LI to the photodetector 261 (and/or 262). A genuine or valid token 10 thus sensed will through the circuit 300 of FIG. 20 result in the coil 77 being energized to pivot the gate 74 allowing the coin/token 10 to continue along its "acceptance" path P to an coin/token reservoir.

Figure 20:
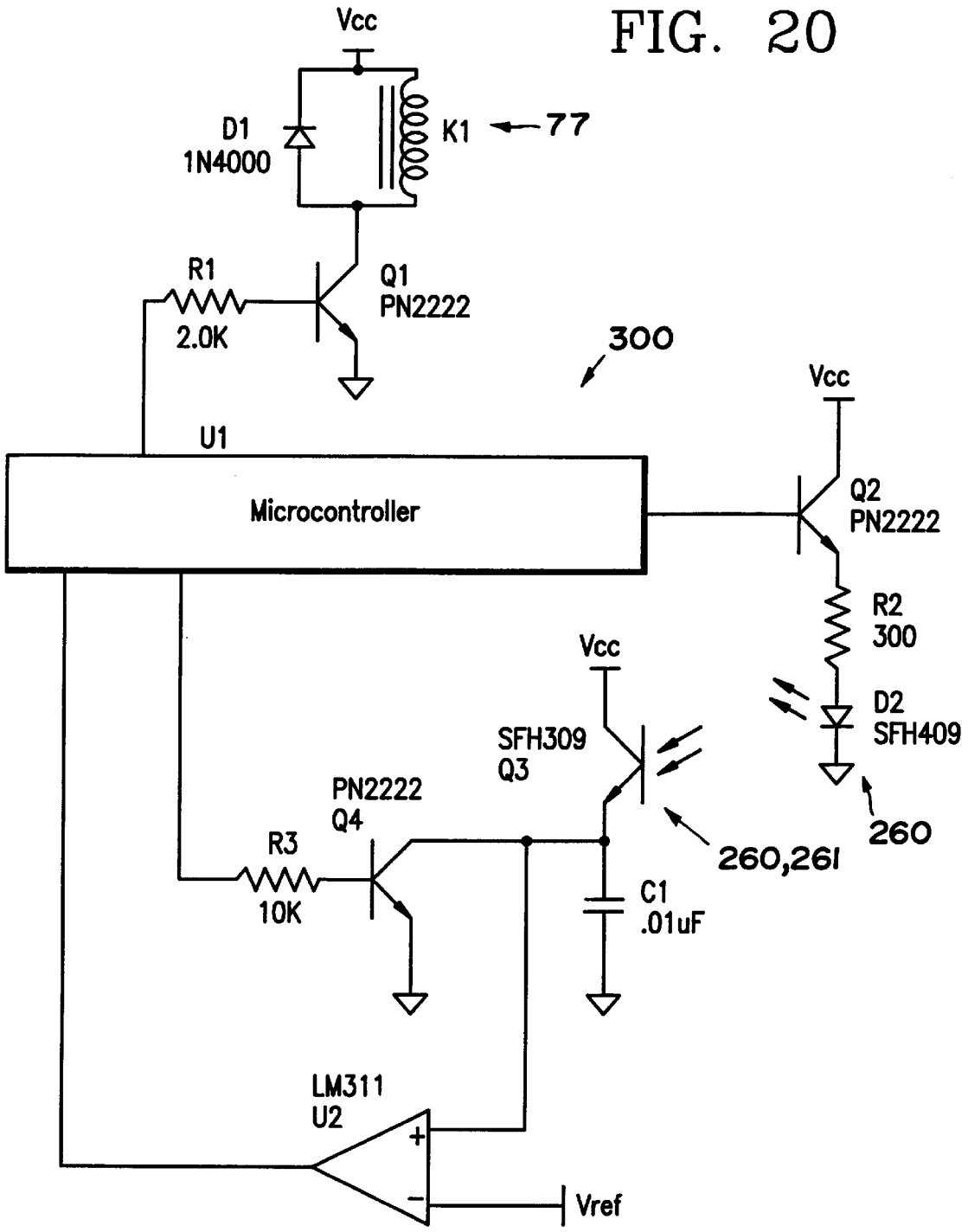
FIG. 20 is a simplified electrical schematic, and illustrates a circuit for testing tokens and activating a gate relay to pass validated/accepted tokens along an "accept" path of the token testing apparatus.

The circuit 300 of FIG. 20 is representative of the functionality of a single optical sensor validation device, whereas multiple optical sensor devices are created by duplicating the LED drive circuitry and placing additional phototransistors in parallel with Q3. A single microcontroller distinguishes between optical sensors by knowing which LED has been activated. Preferably there are two LEDs 260,262 and one phototransistor 261 on each side of the token chute TC. The microcontroller first turns on transistor Q4 through a register R3 to discharge transistor C1. Then transistor Q4 is turned off and transistor Q2 is turned on and causes current to flow through resister R2 and LED D2 (260) thus emitting light through the lens 193 into the token chute TC. If a token 10 is present and positioned so that its facets 18 or 19 are coincident with the light emanating from lens 193 and if the facets are perpendicular to the line bisecting the optical axes of the light source and light detector 260, 261 as viewed in FIG. 16, and perpendicular to the parallel rays emanating from far side of in situ molded lens 193 toward the token 10 as viewed in FIG. 18, then a significant portion of the light will be reflected back through lens 193 to phototransistor Q3 (261). Photocurrent proportional to the received light will flow through phototransistor Q3 into C1 causing the voltage on C1 to rise at a rate proportional to the photocurrent and therefore proportional to the received light intensity. The relative intensity of the reflective light is inversely proportional to the time it takes to charge the capacitor C1 to the reference voltage Vref of a conventional comparator U2. The output of the comparator U2 is monitored by the microcontroller U1 and the time taken to charge the capacitor Q2 to Vref volts is measured by the microcontroller U1. The latter generates a signal to turn on the transistor Q1 through a resistor R1 if the token/coin is acceptable resulting in the gate relay K1, which is in parallel to a diode D1, corresponding to coil 77 being activated. The gate 74 is pivoted to its open position permitting the accepted coin/token 10 to continue on its vertical path P toward deposit in a coin/token reservoir.

Conventional circuitry is utilized for each of the inductive coils 92, 192, once again sensing along the token axis path of travel P and any conventional sensing circuitry, such as that disclosed in the aforementioned patents, can be utilized to sense the annular area 17 or the circular area 14 or both of the token 10, or the similar separately formed areas 14' and 17' of the token 10'. Suffice it to say that due to travel of any of the tokens 10, 10', etc. with the center A thereof at all times moving along the center axis P of the token chute TC, as established by half the distance by any of the guide ribs 112, 113, 133, 133, accurate reliable validation is continually achieved by the validation device 50 of the present invention.

Due to the fact the validation device 50 is readily adapted for sensing, testing and validating a variety of tokens differing in diameter, thickness, transparency and/or opaqueness, alloy content, etc., the same can be utilized with many different coin/token operated devices either in retrofit applications or for different original equipment manufacturers. However, the circuitry 300 must interface with all coin operated devices in a manner which allows one standard acceptor to emulate the electrical interface of other older acceptors, most of which have different electrical plug connectors. This could be done by time consuming rewiring of the various token operated devices to mate with the chosen electrical plug connector style chosen for the token acceptor of this invention. However, to avoid such laborious, time consuming and ofttimes difficult adaptation, the present invention includes as part of the circuit means 300 novel electric plug connector means (FIGS. 12 and 19) generally designated by the reference numeral 400 for accommodating the output of the circuit 300 forming part of the circuit board 190 for utilization with various coin/token operated devices. The electric plug connector means is a so-called "personality plug" 400 which includes a circuit board 401 with appropriate circuitry thereon (not shown) which accommodates the specific electrical connector 403 for utilization with a particular token operated device. The circuit board 400 includes a female pin connector 402 which can be connected to pins 300' of the circuit 300 of the circuit board 190. A plug connector 403 is connectable to a specific coin/token operated device. Thus, no matter the "acceptance" signal transmitted through the pins 300' of the circuit 300, the specific coin/token operated device will be properly activated through the personality plug 400. Thus, the personality plug 400 is utilized as an adaptor for assuring proper validation with a specific coin/token acceptor, but for another OEM coin/token acceptor another personality plug is provided including the identical plug connector 402, but appropriate different circuitry associated with the circuit board 401 and a different plug connector 403 for "personalizing" the validation device to such other coin/token operated device. Therefore, by providing a half dozen or so specifically designed personality plugs 400 with differing circuits 401 and connectors 403, the validation device 50 is adapted for utilization with the vast majority of coin/token operated devices principally utilized in today's commercial environment.

Figure 22:
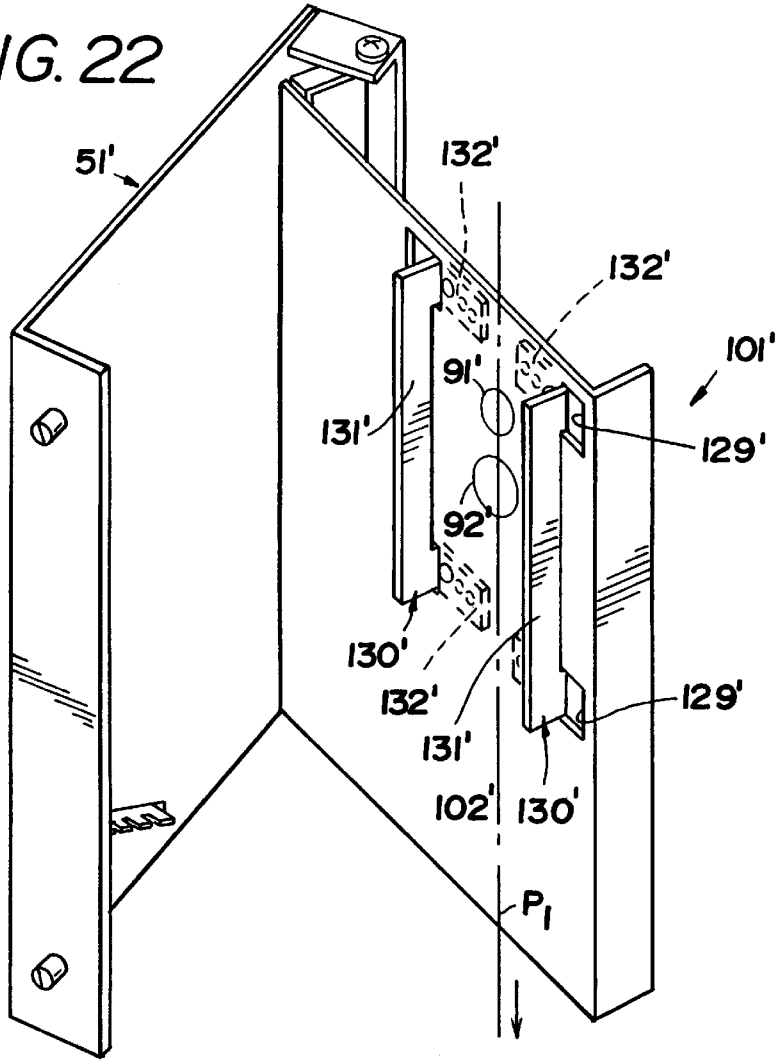
FIG. 22 is a schematic perspective view of another validation device, and illustrates a pair of pivotally connected front and rear housings with the front housing carrying slidably adjustable token guides spaced a minimum distance from each other.
Figure 21:
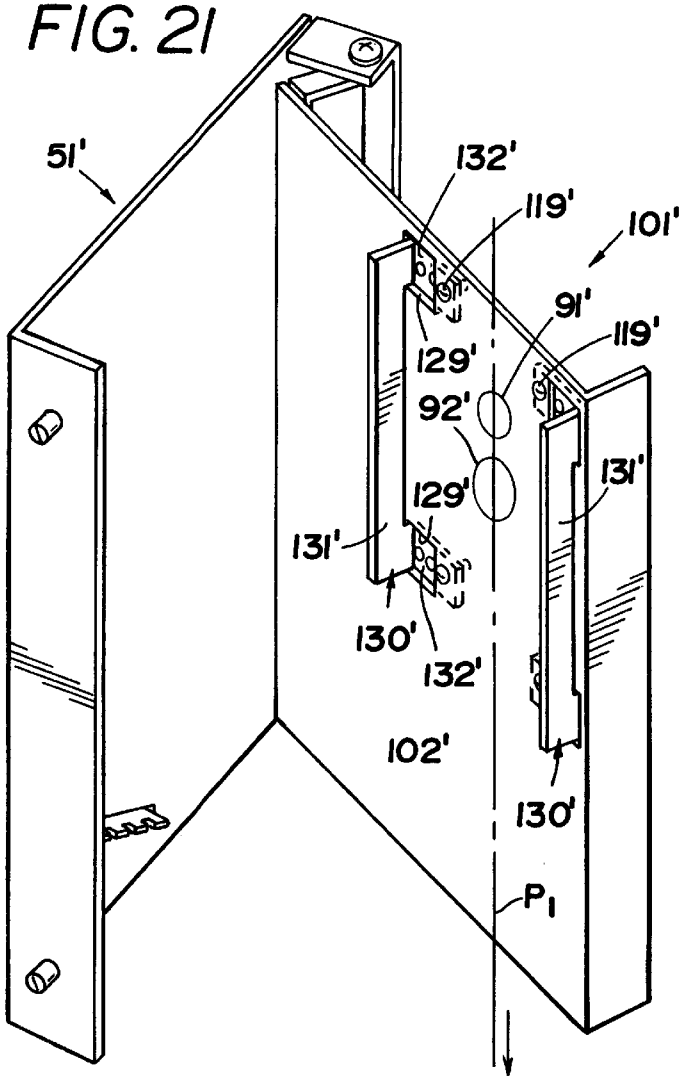
FIG. 21 is a schematic perspective view of another validation device, and illustrates a pair of pivotally connected front and rear housings with the front housing carrying slidably adjustable token guides spaced a maximum distance from each other.

Reference is made to FIGS. 21 and 22 of the drawings in which front and rear housings 101', 51', respectively, are illustrated in pivoted relationship to each other with respective light and inductive sensing means 91' and 92' being diagrammatically shown associated with the front housing 101', though identical light and inductive sensing means can also be associated with the rear housing 51'. However, in lieu of the snap-secured token centering guides or ribs 130 of FIG. 11, comparable token edge guiding means 130' are provided in the form of individual guide ribs 131' each having legs or flanges 132' slidably received in slots or openings 129' of the front wall 102' of the front housing 101'. Fasteners 119' are selectively threaded through threaded holes (unnumbered) in the flanges 132' and bottom against the wall 102' to lock the token guiding ribs 131' at desired perpendicular distances from each other, at all times each being spaced an identical perpendicular distance from the center line or token path of travel P1. Thus, large diameter tokens (FIG. 21) or small diameter tokens (FIG. 22) can equally be validated during passage thereof past the sensors 91', 92' with the axes of such tokens at all times travelling along the token sensing axis P1.

What is claimed is:

1. A token for use with a token operated device comprising a plurality of predetermined optical characteristics, said plurality of predetermined optical characteristics being disposed in a substantially radially symmetrical manner with respect to said token, and each of said optical characteristics having the property of a facet wherein an effective surface normal of said facet is aligned along a predetermined vector angle with an elevation angle ranging substantially between 30° and 60° and an azimuthal angle other than substantially along a radial line of the token or substantially along a line tangent to an annular ring centered on the token such that said token operated device can validate said predetermined optical characteristics substantially independent of token orientation.

2. The token as defined in claim 1 wherein opposite faces of said token have substantially the same said optical characteristics.

3. The token as defined in claim 1 wherein opposite faces of said token have substantially different said optical characteristics.

4. A token as defined in claim 1 including a plurality of second predetermined optical characteristics, said plurality of second predetermined optical characteristics being disposed in a substantially radially symmetrical manner with respect to said token, and each of said second optical characteristics having the property of a facet wherein an effective surface normal of said last-mentioned facet is aligned along a predetermined vector angle with an elevation angle ranging substantially between 30° and 60° and an azimuthal angle other than substantially along a radial line of the token or substantially along a line tangent to an annular ring centered on the token such that said token operated device can validate said second predetermined optical characteristics substantially independent of token orientation.

5. The token as defined in claim 1 wherein each of said plurality of predetermined optical characteristics is curved with respect to an associated chordal line of the token.

6. A token for use with a token operated device comprising a plurality of predetermined optical characteristics, said plurality of predetermined optical characteristics being disposed in a substantially radially symmetrical manner with respect to said token, and each of said optical characteristics having the property of a curved facet wherein the effective surface normal at a point on said curved facet is aligned along a predetermined vector angle with an elevation angle ranging substantially between 30° and 60° and an azimuthal angle other than substantially along a radial line of the token or substantially along a line tangent to an annular ring centered on the token such that said token operated device can validate said predetermined optical characteristics substantially independent of token orientation.

7. The token as defined in claim 6 wherein said plurality of predetermined optical characteristics are disposed along a substantially annular band.

8. The token as defined in claim 6 including a second plurality of predetermined optical characteristics, said second plurality of predetermined optical characteristics being disposed in a substantially radially symmetrical manner with respect to said token, each of said second optical characteristics having the property of a curved facet wherein an effective surface normal at a point on said last-mentioned facet is aligned along a predetermined vector angle with an elevation angle ranging preferably between 30° and 60° and an azimuthal angle other than substantially along a radial line of the token or substantially along a line tangent to an annular ring centered on the token, and said first-mentioned and second plurality of predetermined optical characteristics are on the same face of the token such that said token operated device can validate said second predetermined optical characteristics substantially independent of token orientation.

9. The token as defined in claim 6 including a second plurality of predetermined optical characteristics, said second plurality of predetermined optical characteristics being disposed in a substantially radially symmetrical manner with respect to said token, each of said second optical characteristics having the property of a curved facet wherein an effective surface normal at a point on said facet is aligned along a predetermined vector angle with an elevation angle ranging preferably between 30° and 60° and an azimuthal angle other than substantially along a radial line of the token or substantially along a line tangent to an annular ring centered on the token, and said first-mentioned and second plurality of predetermined optical characteristics are on different face of the token such that said token operated device can validate said second predetermined optical characteristics substantially independent of token orientation.

10. The token as defined in claim 6 including a second plurality of predetermined optical characteristics, said second plurality of predetermined optical characteristics being disposed in a substantially radially symmetrical manner with respect to said token, each of said second optical characteristics having the property of a curved facet wherein an effective surface normal at a point on said curved facet is aligned along a predetermined vector angle with an elevation angle ranging preferably between 30° and 60° and an azimuthal angle other than substantially along a radial line of the token or substantially along a line tangent to an annular ring centered on the token, and said vector angle of said first-mentioned and second plurality of predetermined optical characteristics are substantially the same such that said token operated device can validate said second predetermined optical characteristics substantially independent of token orientation.

11. The token as defined in claim 6 including a second plurality of predetermined optical characteristics, said second plurality of predetermined optical characteristics being disposed in a substantially radially symmetrical manner with respect to said token, each of said second optical characteristics having the property of a curved facet wherein an effective surface normal at a point on said facet is aligned along a predetermined vector angle with an elevation angle preferably between 30° and 60° and an azimuthal angle other than substantially along a radial line of the token or substantially along a line tangent to an annular ring centered on the token, and said vector angle of said first-mentioned and second plurality of predetermined optical characteristics are substantially different such that said token operated device can validate said second predetermined optical characteristics substantially independent of token orientation.

12. The token as defined in claim 8 wherein said first-mentioned and second plurality of predetermined optical characteristics are each disposed along a substantially annular band.

13. The token as defined in claim 9 wherein said first-mentioned and second plurality of predetermined optical characteristics are each disposed along a substantially annular band.

14. The token as defined in claim 10 wherein said first-mentioned and second plurality of predetermined optical characteristics are each disposed along a substantially annular band.

15. The token as defined in claim 11 wherein said first-mentioned and second plurality of predetermined optical characteristics are each disposed along a substantially annular band.

16. The token as defined in any of claims 1 through 15 wherein said predetermined optical characteristics include reflective facets.

17. The token as defined in any of claims 1 through 15 wherein said predetermined optical characteristics include refractive facets.

18. The token as defined in any of claims 1 through 15 wherein said predetermined optical characteristics include holographic or diffraction gratings.

19. A token comprising a face having a plurality of predetermined optical characteristics disposed between circular lines defining therebetween a substantially annular band relative to a center A with each optical characteristic being curved relative to a chord line passing through a reference point X in said annular band through which also passes a radius of the token, the chord line and radius defining an included angle θ, and successive optical characteristics are formed in the face by rotating the token about its center A by a rotation angle RT defined by the equation $$RT = \mathrm{Tan}^{-1}\left\{\frac{d}{(AX)(\cos\theta)}\right\}$$

where d is the perpendicular distance between said predetermined optical characteristics and AX is the length of the radial line between the center A and the reference point X.

20. The token as defined in claim 19 wherein each optical characteristic is a facet between said circular lines.

21. The token as defined in claim 19 wherein each optical characteristic is a groove having opposite peaks located one at each of said circular lines.

* * * * *